US006329804B1

(12) United States Patent
Mercer

(10) Patent No.: US 6,329,804 B1
(45) Date of Patent: Dec. 11, 2001

(54) SLOPE AND LEVEL TRIM DAC FOR VOLTAGE REFERENCE

(75) Inventor: Mark J. Mercer, Tuscon, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/416,896

(22) Filed: Oct. 13, 1999

(51) Int. Cl.[7] ..... G05F 3/16; G05F 3/20

(52) U.S. Cl. ..... 323/315; 323/314

(58) Field of Search ..... 323/313, 314, 323/315, 316

(56) References Cited

U.S. PATENT DOCUMENTS

| | | | |
|---|---|---|---|
| 3,887,863 | 6/1975 | Brokaw | 323/19 |
| 4,190,805 | 2/1980 | Bingham | 330/9 |
| 4,250,445 | 2/1981 | Brokaw | 323/313 |
| 4,543,522 | 9/1985 | Morean | 323/303 |
| 4,603,291 | 7/1986 | Nelson | 323/315 |
| 4,613,809 | 9/1986 | Skovmand | 323/268 |
| 4,792,747 | 12/1988 | Schroeder | 323/303 |
| 4,803,612 | 2/1989 | Skovmand | 323/284 |
| 4,808,908 | 2/1989 | Lewis et al. | 323/313 |
| 4,902,959 | 2/1990 | Brokaw | 323/314 |
| 4,906,913 | 3/1990 | Stanojevic | 323/303 |
| 4,926,109 | 5/1990 | Koterasawa | 323/274 |
| 4,928,056 | 5/1990 | Pease | 323/314 |
| 5,126,653 | 6/1992 | Ganesan et al. | 323/313 |
| 5,168,209 | 12/1992 | Thiel | 323/313 |
| 5,191,278 | 3/1993 | Carpenter | 323/275 |
| 5,274,323 | 12/1993 | Dobkin et al. | 323/280 |
| 5,291,122 | 3/1994 | Audy | 323/313 |
| 5,325,045 | 6/1994 | Sundby | 323/313 |
| 5,334,928 | 8/1994 | Dobkin et al. | 323/280 |

(List continued on next page.)

OTHER PUBLICATIONS

B. Song and P.R. Gray, "A Precision Curvature–Compensated CMOS Bandgap Reference," *JSSC*, pp. 634–643, Dec. 1983.

Holman, Timothy, "A New Temperature Compensation Technique for Bandgap Voltage References," *ISCAS*, pp. 385–388, 1996.

Rincon–Mora, G.A. and Allen, P.E., A 1.1V Current_Mode and Piecewise–Linear Curvature–Corrected Bandgap Reference, *JSSC*, pp. 1551–1554.

Gray, P.R. and Meyer, R.G., "Band–Gap Referenced Biasing Circuits," section A4.3.2 in *Analysis and Design of Analog Integrated Circuits*, 3rd ed.

(List continued on next page.)

*Primary Examiner*—Peter S. Wong
*Assistant Examiner*—Bao Q. Vu
(74) *Attorney, Agent, or Firm*—Beyer, Weaver & Thomas LLP

(57) ABSTRACT

A method and apparatus for trimming the level and slope in a voltage reference using current-switching DACs to inject small correction currents into or draw currents from the voltage reference circuit. Each DAC is controlled via a programmable non-volatile memory, which can be programmed after final packaging. Thus, the present technique enables trimming the voltage reference circuit after the circuit has been packaged. For the slope trim, the current is injected into or drawn from one side or the other of the band-gap core cell. The level trim DAC sources a correction current into or sinks a correction current from the resistor chain that sets the voltage level at the base of the transistors in the band-gap core. The level and slope trim DACs generate currents that are precise multiples of the currents through the resistors being trimmed. Thus the corrections are invariant with process and temperature, the necessary trim range is minimized, and the shape of the remaining error (curvature) is not altered. This current replication technique has the same effect as an ideal trim, i.e. produces the same result as changing the values of the resistors around which the trim circuits are placed.

45 Claims, 7 Drawing Sheets

U.S. PATENT DOCUMENTS

| | | | |
|---|---|---|---|
| 5,352,973 | 10/1994 | Audy | 323/313 |
| 5,391,980 | 2/1995 | Thiel et al. | 323/314 |
| 5,410,241 | 4/1995 | Cecil | 323/315 |
| 5,485,109 | 1/1996 | Dobkin et al. | 327/77 |
| 5,510,697 | 4/1996 | Dormer | 323/273 |
| 5,519,308 | 5/1996 | Gilbert | 323/313 |
| 5,563,504 | 10/1996 | Gilbert et al. | 323/316 |
| 5,629,609 | 5/1997 | Nguyen et al. | 323/269 |
| 5,631,598 | 5/1997 | Miranda et al. | 327/540 |
| 5,672,959 | 9/1997 | Der | 323/273 |
| 5,675,241 | 10/1997 | Teggatz et al. | 323/282 |
| 5,677,558 | 10/1997 | McGlinchey | 257/370 |
| 5,686,821 | 11/1997 | Brokaw | 323/273 |
| 5,705,919 | 1/1998 | Wilcox | 323/282 |
| 5,736,843 | 4/1998 | Amin | 323/273 |
| 5,814,979 | 9/1998 | Grimm | 323/284 |
| 5,867,015 | 2/1999 | Corsi et al. | 323/316 |

OTHER PUBLICATIONS

Sze, S.M., "Carrier Transport Phenomena," section 1.5 in *Physics of Semiconductor Devices*, 2$^{nd}$ ed. (Wiley, 1981).

Annema, Anne–Johan, "Low–Power Bandgap References Featuring DTMOST's," *IEEE Journal of Solid–State Circuits*, vol. 34, No. 7, pp. 949–955, Jul. 1999.

Banba, Hironori et al., "A CMOS Bandgap Reference Circuit with Sub–1–V Operation," *IEEE Journal of Solid–State Circuits*, vol. 34, No. 5, pp. 670–673, May 1999.

Sudha, Maramreddy and Holman, W. Timothy, "A Low Noise Sub–Bandgap Voltage Reference," *IEEE*, pp. 193–196, 1997.

Pease, Robert A., "The Design of Band–Gap Reference Circuits: Trials and Tribulations," *IEEE 1990 Bipolar Circuits and Technology Meeting 9.3*, pp. 214–218.

Lin, S.L. and C.A.T. Salama, "Regular Correspondence," *IEEE Journal of Solid–State Circuits*, vol. SC–20, No. 6, pp. 1283–1285, Dec. 1985.

Michejda, John and Kim, Suk. K., "A Precision CMOS Bandgap Reference," *IEEE Journal of Solid–State Circuits*, vol. SC–19, No. 6, pp. 1014–1021, Dec. 1984.

Palmer, Carl R. and Dobkin, Robert C., "A Curvature Corrected Micropower Voltage Reference," *Session VI: Data Acquisition Circuits, ISSCC 81*, pp. 58–59, Feb. 18, 1981.

Frederiksen, Thomas M., "Intuitive IC OP Amps," From-BAsics to Useful Applications, *National's Semiconductor Technology Series*, pp. 8–12, 1984.

"IC Preamplifier Challenges Choppers on Drift," *National Semiconductor*, Application Notes 79–81, pp. 279–281.

SLOPE AND LEVEL TRIM DAC FOR VOLTAGE REFERENCE

The present invention is related to U.S. Pat. application No. 09/416,899, entitled "CMOS VOLTAGE REFERENCE WITH A NULLING AMPLIFIER" attorney docket number NSC1P144, filed Oct. 13, 1999, now U.S. Pat. No. 6,201,379, issued on Mar. 13, 2001; U.S. Pat. application No. 09/416,897, entitled "CMOS VOLTAGE REFERENCE WITH POST-ASSEMBLY CURVATURE TRIM" attorney docket number NSC1P141/NS4406, filed Oct. 13, 1999, now U.S. Pat. No. 6,218,822, issued on Apr. 17, 2001; and U.S. Pat. application No. 09/416,899, entitled "LOW DROPOUT VOLTAGE REFERENCE" attorney docket number NSC1P142/NS4320, filed Oct. 13, 1999, now U.S. Pat. No. 6,198,266, issued on Mar. 06, 2001; all applications are commonly assigned to the assignee of the present invention, and the disclosures of which are herein incorporated by reference.

BACKGROUND OF THE INVENTION

1. Field of the Invention

The present invention relates generally to the field of CMOS voltage references, and more particularly to a method and apparatus for performing slope and level trim in a voltage reference.

2. Description of the Related Art

Using a CMOS process to make a voltage reference has cost advantages over a precision-trimmed bipolar process. Problems with the accuracy and stability of CMOS devices must be overcome, however, in order to make a CMOS reference competitive in performance with bipolar references. Specifically, the lack of high-value stable and trimmable resistors presents a problem for circuit designers.

In order to adjust for variances in each circuit, voltage references are "trimmed" after manufacture in order to bring the output values within a specified range. This is generally accomplished by using lasers to etch away certain thin-film resistors (thereby increasing the resistance by decreasing the cross-sectional area). With proper design, most devices can be brought within the specified range using this technique. However, once the device (i.e. silicon die) is placed into a package, the mechanical stresses caused by the packaging can once again cause the circuit parameters to vary. Therefore, a competitive CMOS voltage reference must be designed such that the circuit may be "trimmed" after the final assembly of the die into a package.

One possible solution is to provide a series of resistors that can be switched in or out, as necessary, after final assembly in order to trim the slope and level of the output. This solution requires a large array of MOS switches, which have large resistance when the supply voltage is low. This resistance was found to contribute significant errors to the final reference voltage-errors that had variations with process and temperature and supply unrelated to the normal variations in the core cell. Another difficulty with using analog switches for trimming is that it is very cumbersome to change the trim range. This might be necessary, for example, in a reference with multiple voltage level options where multiple ranges of trim current are required.

Thus, it would be desirable to have an improved slope and level trim technique, suitable for use with CMOS voltage references, and providing post assembly trim.

SUMMARY OF THE INVENTION

The present invention is a method and apparatus for trimming the level and slope in a voltage reference. The present invention uses current-switching DACs to source (or sink) small correction currents into (from) the voltage reference circuit. Each DAC is controlled via a programmable non-volatile memory, which can be programmed after final packaging.

For the slope trim, the current is injected into (or drawn from) one side or the other of the band-gap core cell. The level trim DAC injects a correction current into (or draws a correction current from) the resistor chain that sets the voltage level at the base of the transistors in the band-gap core. The level and slope trim DACs generate or draw currents that arc precise multiples of the currents through the resistors being trimmed, via current mirrors. Thus the corrections are invariant with process and temperature, the necessary trim range is minimized, and the shape of the remaining error (curvature) is not altered. This current replication technique has the same effect as an ideal trim, i.e. produces the same result as changing the values of the resistors around which the trim circuits are placed.

The present invention trims the voltage reference without using switches in the main a circuit path. Also, the present technique enables trimming the voltage reference circuit after the circuit has been packaged, providing for better circuit calibration.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

The following description is provided to enable any person skilled in the art to make and use the invention and sets forth the best modes contemplated by the inventor for carrying out the invention. Various modifications, however, will remain readily apparent to those skilled in the art, since the basic principles of the present invention have been defined herein specifically to provide a method and apparatus for performing slope and level trim in a voltage reference.

Figure 1:
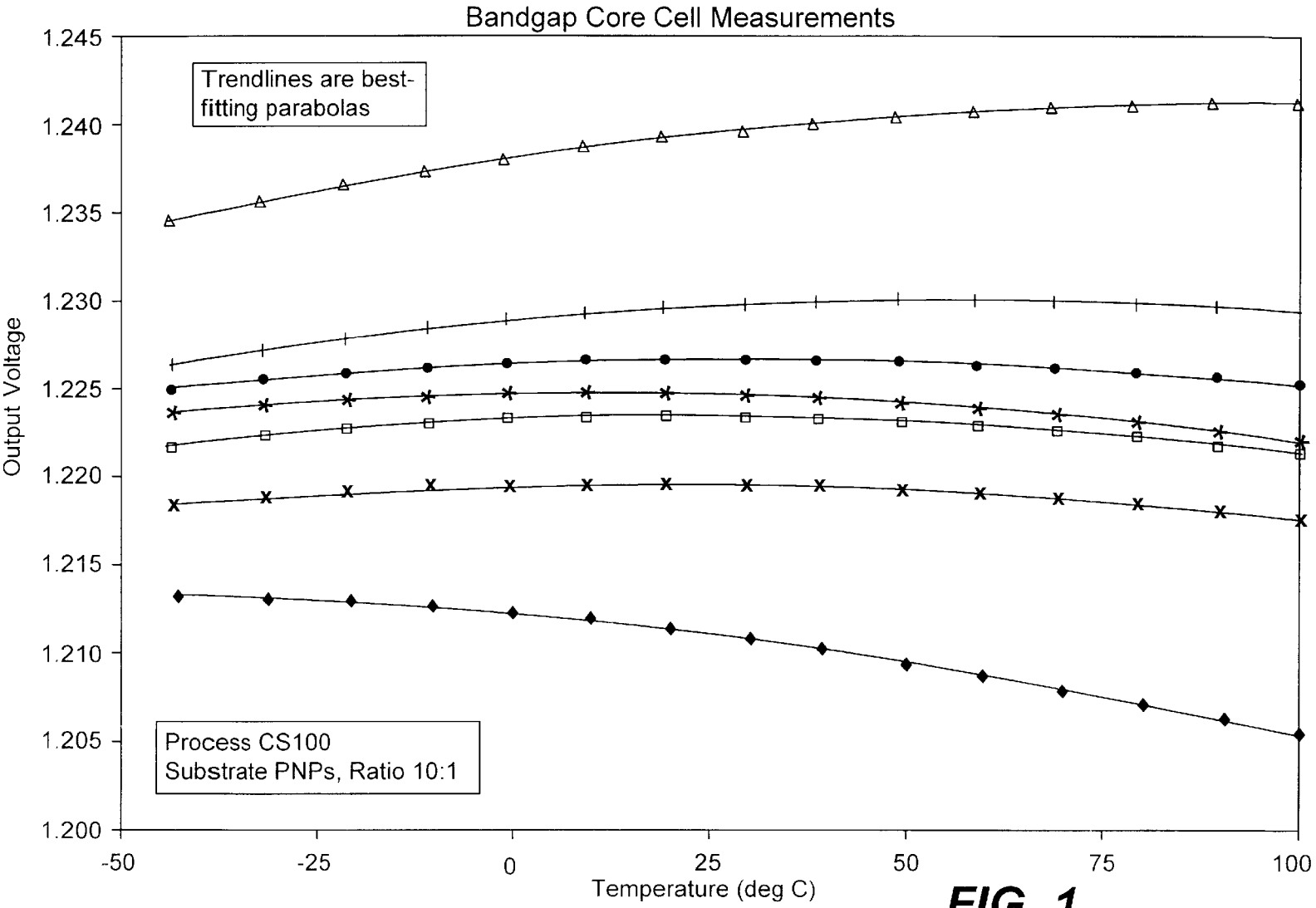
FIG. 1 is a graph of output voltage vs. temperature for actual data from seven band-gap voltage references.

In general, the basic output voltage signal from a series of voltage references will not be identical due to the numerous variations in circuit parameters. For example, as shown in FIG. 1, actual data taken from seven different voltage references of the same design show a disparity in the output voltage vs. temperature. Notice that each curve has a different voltage "level" and each curve has a different "slope." The top curve, for instance, has a positive slope, whereas the bottom curve has a negative slope. For commercial grade voltage references, the level and slope must be trimmed (i.e. adjusted) in each reference, in order for each device to comply with predetermined device specification.

Figure 2:
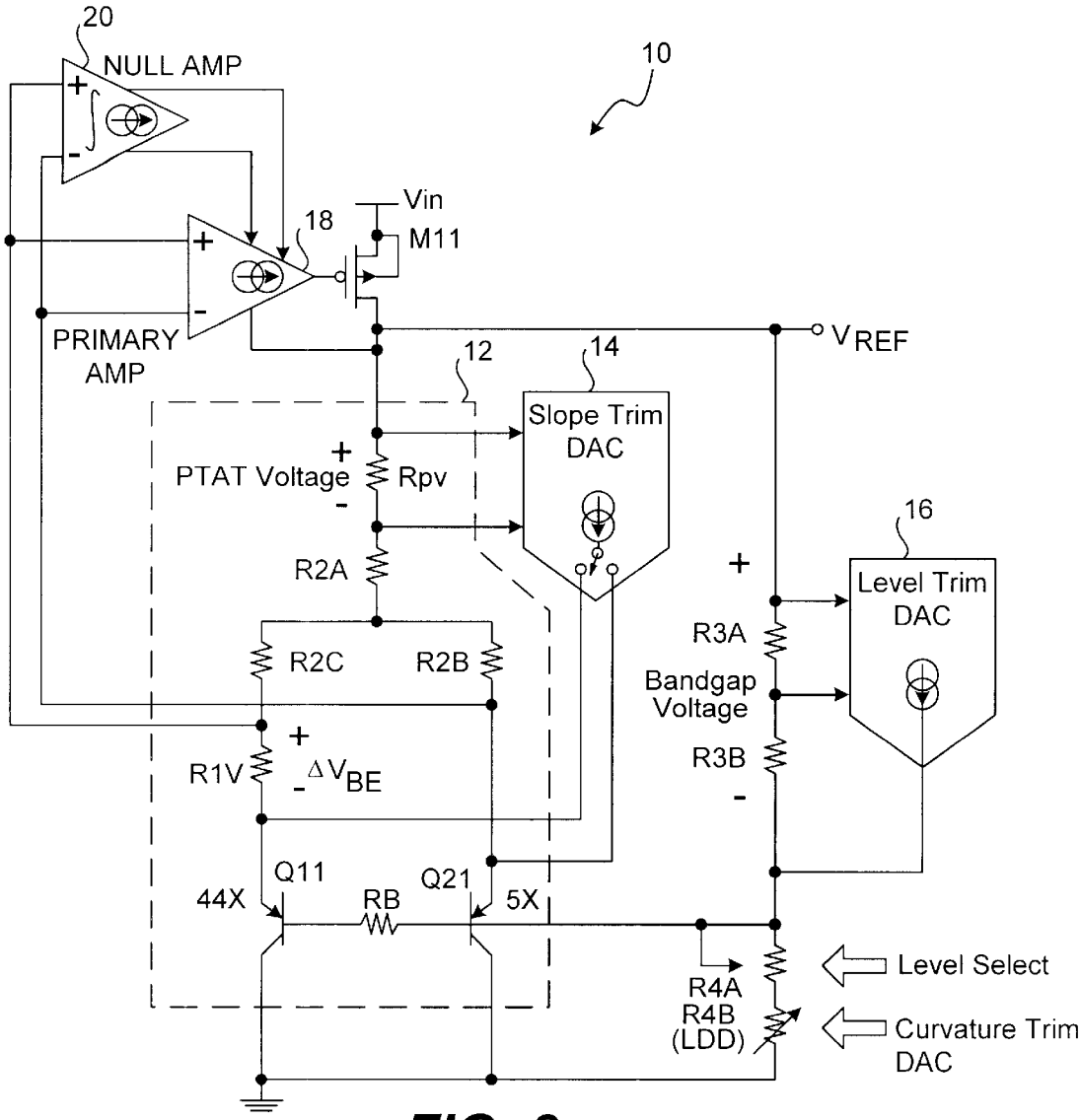
FIG. 2 is a block diagram of a low dropout voltage reference incorporating the present invention, and of the type used to generate the data of FIG. 1.

FIG. 2 is block diagram of a CMOS voltage reference 10 that incorporates the present invention, and which was used to generate the data of FIG. 1. The voltage reference 10 comprises a band-gap core 12, connected to a primary amplifier 18, an output FET M11, and a null amplifier 20. The circuit further comprises a slope trim DAC 14 and a level trim DAC 16 for adjusting the slope and level of the output $V_{REF}$. A level select R4A selects one of the available output voltage options, for example, the circuit can be designed to output three different $V_{REF}$ values. Finally, the curvature trim DAC R4B is shown as a potentiometer to illustrate that it has a variable resistance, but it actually consists of a network of non-linear resistors that can be controlled by setting a non-volatile memory. In fact, the slope, level and curvature trims can be performed after final packaging via the non-volatile memory. The CMOS voltage reference 10 of FIG. 2 provides a precision voltage reference that can be manufactured in a standard CMOS process and trimmed after final assembly.

The ideal way to trim the slope and level of the reference would be to adjust the values of R1V and R4A directly (FIG. 2). However, simply adjusting a potentiometer to change the voltage up or down is not practical for CMOS wafer design. A voltage reference circuit could be trimmed by using analog switches in series with either series or shunt resistors. Switches in series with resistors, though, would cause problems due to the variations in the switch resistance that could not be trimmed out. Also, as discussed previously, the resistor values could be modified by using a laser to etch thin-film resistors during a calibration procedure. However, this procedure can not be used after the device has already been packaged.

The present solution solves the trimming problem by sourcing or sinking a current into or out of a node, thereby changing the magnitude of the current and the associated voltage $V_{REF}$. In other words, injecting or drawing a current has the same effect as modifying the resistor values. However, not just any current with any temperature coefficient (TC) will work. Since the TC of the injected or drawn current would ultimately affect the TC of $V_{REF}$, the injected or drawn current needs to have a TC that tracks the TC of the current already flowing in the voltage reference circuit (i.e. the current flowing through R3A).

According to the present invention, level and slope trimming is accomplished using current-switching DACs to inject or draw small correction currents into or out of the voltage reference circuit. Each DAC is controlled via a programmable non-volatile memory, such as an EEPROM. Since, the EEPROM can be programmed after final packaging, the present invention provides a technique to trim the voltage reference devices after the circuit has been packaged. As shown in FIG. 2, for the slope trim, the current is injected into or drawn from one side or the other of the band-gap core cell 12. The level trim DAC 16 injects a correction current and into or draws a correction current from the resistor chain that sets the voltage level at the base of the transistors Q11, Q21 in the band-gap core 12.

The level and slope trim DACs 14, 16 generate currents that are precise multiples of the currents through the resistors being trimmed. Thus the corrections are substantially invariant with process and temperature, the necessary trim range is minimized, and the shape of the remaining error (curvature) is not altered. This current replication technique has the same effect as an ideal trim, i.e. produces the same result as changing the values of the resistors around which the trim circuits are placed.

Figure 3:
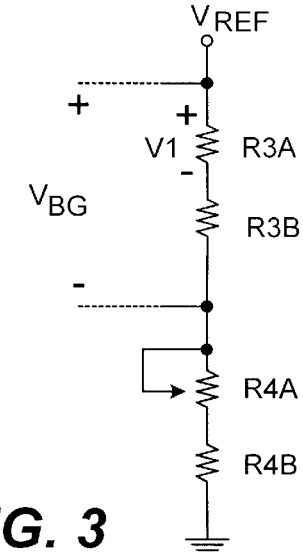
FIG. 3 is a schematic of a resistor network from FIG. 2 used for level trim.

FIG. 3 illustrates the ideal trim for making fine adjustments on the level of the output voltage of the reference. The resulting expression for the output voltage of the reference is $$V_{REF} = V_1\left(1 + \frac{R_{3B} + R_{4A} + R_{4B}}{R_{3A}}\right)$$

where the value of $R_{4A}$ is adjustable and $$V_1 = V_{BG}\left(\frac{R_{3A}}{R_{3A} + R_{3B}}\right)$$

and $V_{BG}$ is the band-gap voltage (a constant).

However, since there is no way to implement an ideal potentiometer (i.e. R4A) with EEPROM based trimming, a current replication circuit is employed. The circuit operation will now be described with reference to FIG. 4, which illustrates a current sourcing embodiment. The voltage V1 across R3A is replicated across R5 by the feedback action of the output transconductance amplifier (OTA) and transistor M1. This creates a current in M1 ($I_{M1}=V_1/R_5$) that is mirrored by M2. M2 comprises a selectable set of current mirrors M2A–M2*, which can multiply the current mirrored by M1. M2 supplies a reference current to the controlling diode, M3, of the current output DAC consisting of M3 through M7. The output of the current DAC is fed back to the node between R3B and R4A. The resulting expression for the output voltage of the reference is:

$$V_{REF} = V_1\left(1 + \frac{R_{3B}}{R_{3A}}\right)V_1\left(\frac{1}{R_{3A}} + \frac{K * Bit1}{R_5} + \frac{K * Bit2}{2R_5} + \frac{K * Bit3}{4R_5} + \cdots + \frac{K * BitN}{2^{N-1}R_5}\right)(R_{4A} + R_{4B})$$

where Bit*=1 or 0, and K is a function of the relative channel width to length ratios of M1 to M2, and the state of the switches SW*. Note that the band-gap voltage $V_{BG}$=V1+V2. Two "matching" switches, one at the source of M1 and one at the source of M3, are always closed and help improve the accuracy of the currents in the mirror. In one embodiment, where M1=1×(size), the relative sizes of the second current mirror are M5=½X, M6=¼X, and M7=($\frac{1}{2}^{N-1}$)X.

As seen from the equations above, changing the code of the DAC (i.e. selecting an appropriate combination of FETs) has the same effect as changing the value of R4A. Specifically, using the present invention, the resistor ratio multiplying V1 is adjusted. Also note that the injected current has a TC that tracks the TC of the current flowing through R3A. The switches used to control the FETs in the current mirrors are located outside of the main voltage reference circuit, and therefore do not cause the same problems associated with switching in resistors in the main circuit.

The same DAC can be used for all voltage reference level options by simply selecting the appropriate reference current (K*(V1/R5)) via M2 and its multipliers. Thus, the present invention provides a "selectable trim" providing different trimming steps, depending upon a desired output reference voltage level. For example, if the voltage reference has three different output levels, ideally the scaling factor would provide the same percentage step of the total $V_{REF}$ for each level. This can be accomplished by selecting the appropriate ratio of M1 to M2, via the M2 switches. If only one voltage level is needed, M2 can comprise a single FET to mirror the current at a fixed ratio. Finally, the DAC code can be programmed after the voltage reference, has been packaged, during a final calibration procedure, thus providing a post assembly level trim.

The slope trim DAC circuit 14 operated exactly as the level trim DAC 16 discussed above with reference to FIG. 4. As shown in FIG. 2, the slope is adjusted by taking a current that has similar TC characteristics to the current flowing in resistor Rpv, replicating the current in the slope trim DAC, and then injecting the correction current into one side of the band-gap core 12, i.e. either the emitter of Q11 or the emitter of Q21. The output of the slope trim DAC 14 is selectable to allow the slope to be adjusted either up or down. The injected current changes the magnitude of the delta Vbe term in the band-gap and thereby changes the slope of the output voltage $V_{REF}$.

Figure 5:
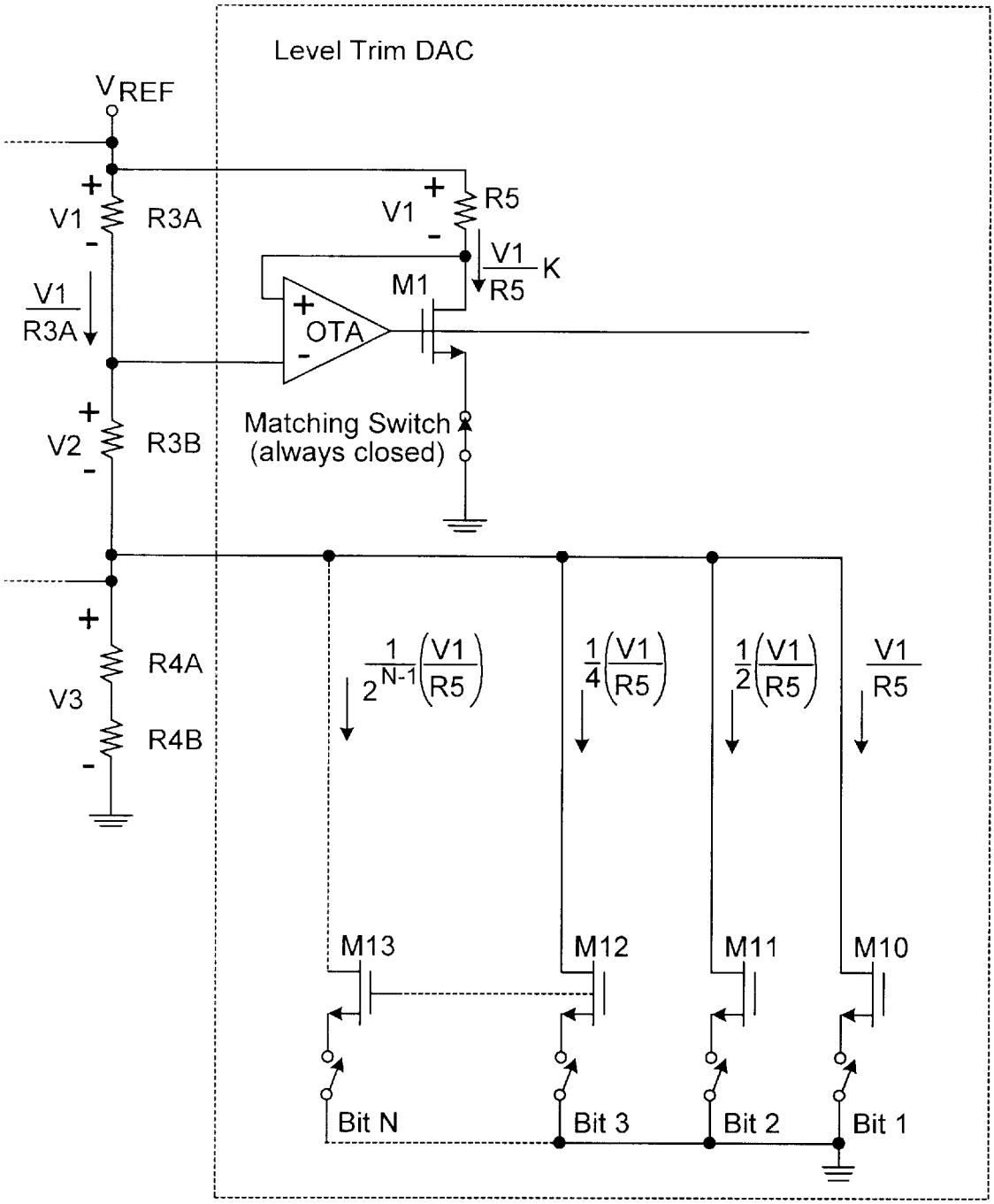
FIG. 5 is a schematic of a trim DAC according to a second embodiment of the present invention.

The present invention may also be implemented as a current sinking DAC as shown in FIG. 5. In this case, the current mirror comprising FETS M10–M13 is drawing current out of the R3B/R4A node. Note that the TC of the current drawn again "tracks" the TC of the current flowing through R3A. The equation for $V_{REF}$ is:

$$V_{REF} = V_1\left(1 + \frac{R_{3B}}{R_{3A}}\right)V_1\left(\frac{1}{R_{3A}} - \frac{K * Bit1}{R_5} - \frac{K * Bit2}{2R_5} - \frac{K * Bit3}{4R_5} - \cdots - \frac{K * BitN}{2^{N-1}R_5}\right)(R_{4A} + R_{4B})$$

where Bit*=1or 0, K is a function of the relative channel width to length ratios of M1 to M10, and $V_{BG}$=V1+V2. One limitation of drawing current out of the node between R3B and R4A is that V3 must be greater than the Vdsat of the n-channel current sources (M10–M13)

A current sinking slope trim DAC circuit 14 operates exactly as the level trim DAC 16 discussed above with reference to FIG. 5. As shown in FIG. 2, the slope is adjusted by taking a current that has similar TC characteristics to the current flowing in resistor Rpv, replicating the current in the slope trim DAC 14, and then sinking a correction current from one side of the band-gap core, i.e. either the emitter of Q11 or the emitter of Q21. The output of the slope trim DAC 14 (which is really an "input" for the current sink) is selectable to allow the slope to be adjusted either up or down. The drawn current changes the magnitude of the delta Vbe term in the band-gap and thereby changes the slope of the output voltage $V_{REF}$.

Figure 4:
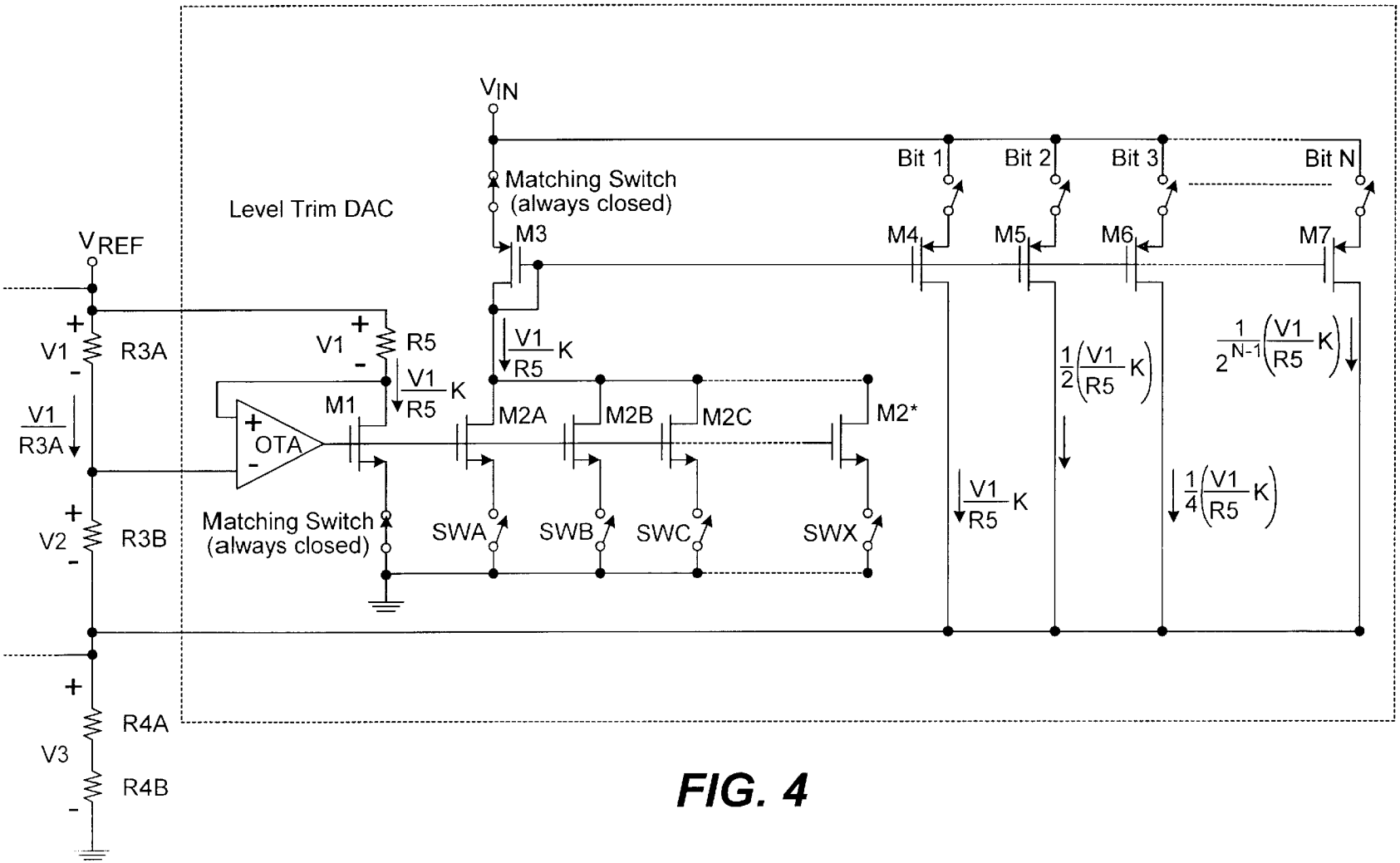
FIG. 4 is a schematic of a trim DAC according to a first embodiment of the present invention.
Figure 6:
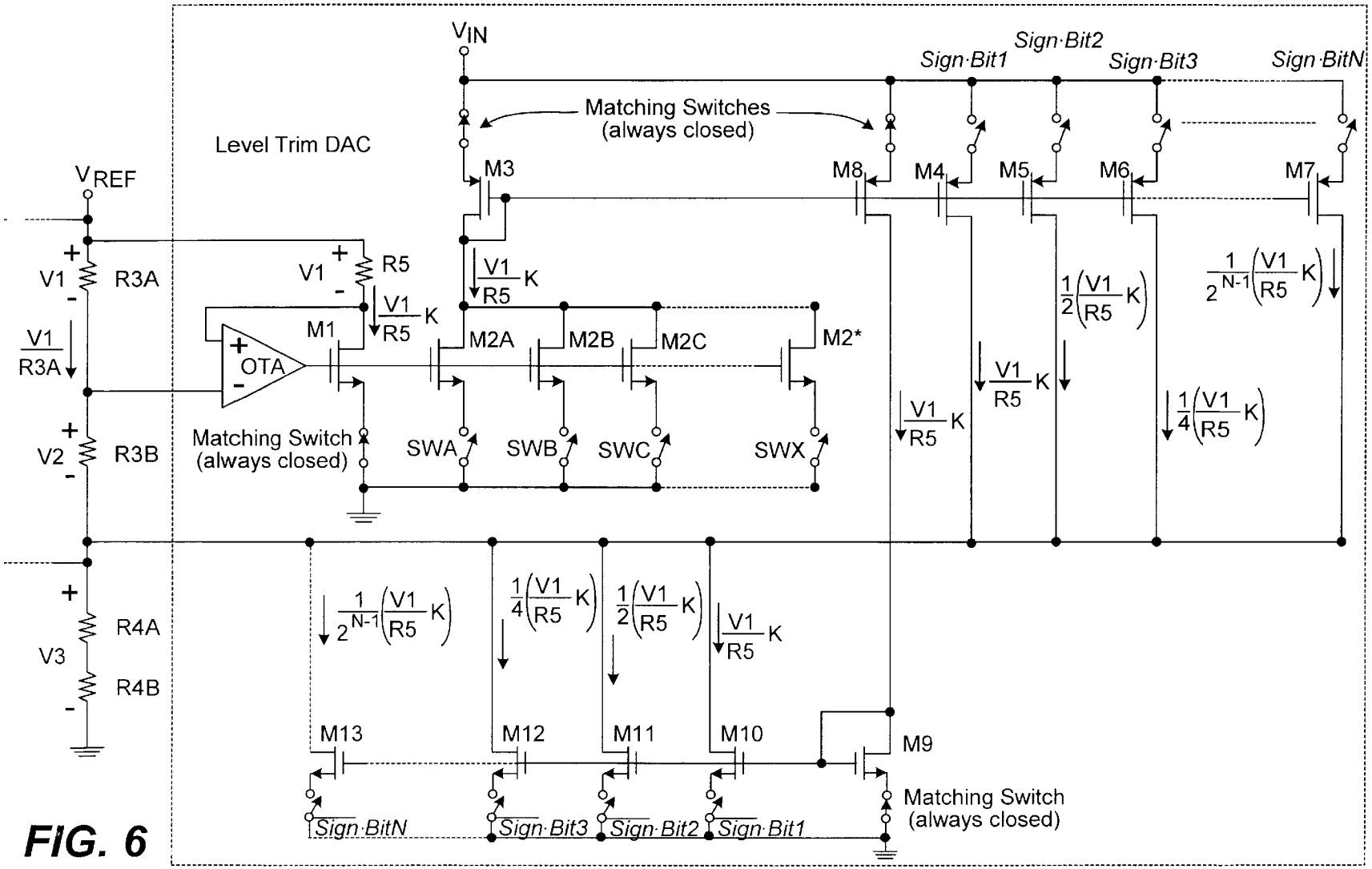
FIG. 6 is a schematic of a trim DAC according to a third embodiment of the present invention.

The embodiments illustrated in FIGS. 4 and 5 provide a "one-way" trim, that is, the current is either injected or drawn from a node, exclusively. The component values in the voltage reference circuit must be selected to provide an appropriate trim range for a given one-way trim. However, both current sourcing and sinking may be combined in a single circuit as shown in FIG. 6. In this case, whether the current is injected or drawn from the node is selectable, and $V_{REF}$ is determined by the following equations:

$$\text{Sign} = 1 : V_{REF} = V_1\left(1 + \frac{R_{3B}}{R_{3A}}\right) + V_1\left(\frac{1}{R_{3A}} + \frac{K * Bit1}{R_5} + \frac{K * Bit2}{2R_5} + \frac{K * Bit3}{4R_5} + \cdots + \frac{K * BitN}{2^{N-1}R_5}\right)(R_{4A} + R_{4B})$$

$$\text{Sign} = 0 : V_{REF} = V_1\left(1 + \frac{R_{3B}}{R_{3A}}\right) + V_1\left(\frac{1}{R_{3A}} - \frac{K * Bit1}{R_5} - \frac{K * Bit2}{2R_5} - \frac{K * Bit3}{4R_5} - \cdots - \frac{K * BitN}{2^{N-1}R_5}\right)(R_{4A} + R_{4B})$$

where Bit*=1 or 0, K is a function of the relative channel width to length ratios of M1 to M2 and the state of the switches SW*, and $V_{BG}$=V1+V2. "Sign" is a logic input signal to select whether to source or sink current. For example, to increase $V_{REF}$, Sign=1, and to decrease $V_{REF}$, Sign=0. One limitation of drawing current out of the node between R3B and R4A is that V3 must be greater than the Vdsat of the n-channel current sources (M9–M13).

Figure 7:
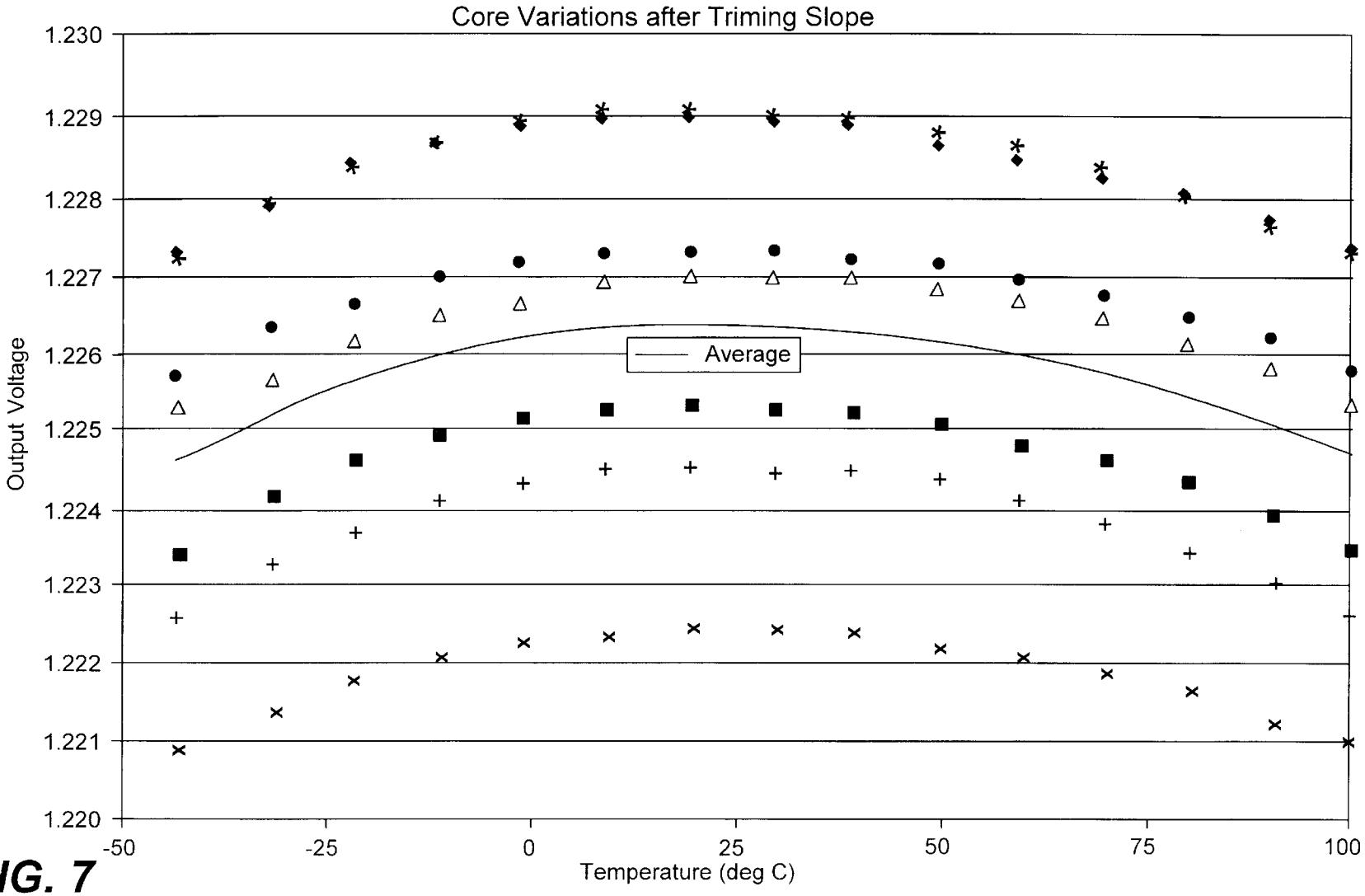
FIG. 7 is a graph of the data of FIG. 1, after the slope has been trimmed.
Figure 8:
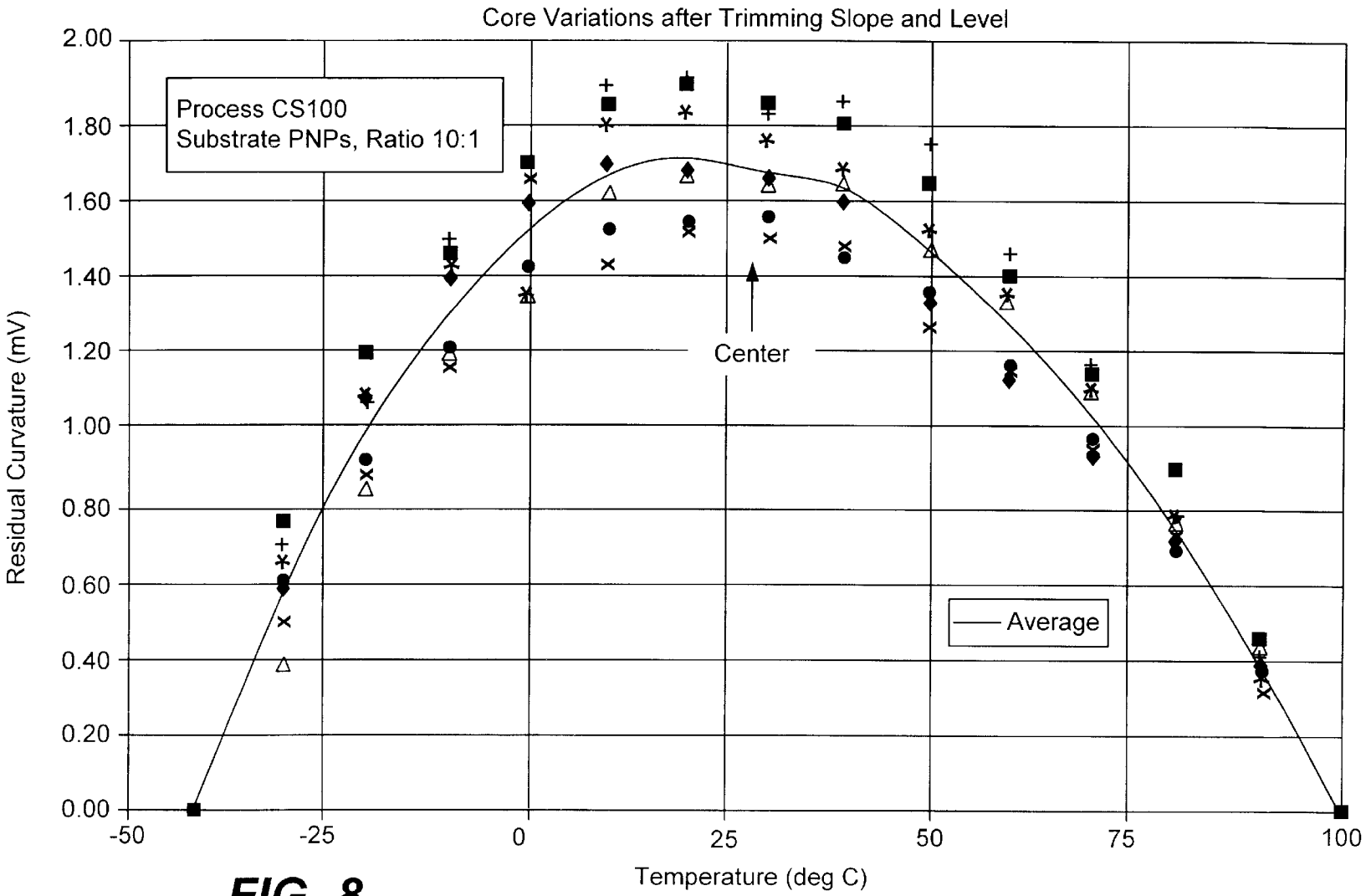
FIG. 8 is a graph of the data of FIG. 1, after both the slope and level have been trimmed.

FIG. 7 is a graph of the data from the voltage references of FIG. 1 after the slope has been trimmed according to the present invention. Notice that the start points and end points for each curve are now roughly at the same level. FIG. 8 is a graph of the same data after the level has been trimmed as well. The remaining curvature may be trimmer out by using methods known to those skilled in the art, or by the technique disclosed in the related U.S. Pat. application No. 09/416,897, entitled "CMOS VOLTAGE REFERENCE WITH POST-ASSEMBLY CURVATURE TRIM" attorney docket number NSC1P141/NS4406, filed Oct. 13, 1999, now U.S. Pat. No. 6,218,822, issued on Apr. 17, 2001.

Thus, according to the present invention, the level and slope trim in a voltage reference can be performed without using switches in series with resistors. Also, since the switches controlling the FETs may be selected via a programmable non-volatile memory, the voltage reference can be trimmed even after final assembly.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A circuit for adjusting the level or slope trim in a voltage reference, the circuit comprising:

a differential amplifier connected across a reference resistor having a first terminal and a second terminal;

a first current mirror connected to an output of the differential amplifier; and a second current mirror connected to the first current mirror.

2. The circuit of claim 1, further comprising an output node connected to the second current mirror, wherein the second current mirror sources a current through the output node to the voltage reference.

3. The circuit of claim 2, wherein the first current mirror comprises a control transistor and at least one mirror transistor.

4. The circuit of claim 3, wherein an output of the differential amplifier is connected to the control transistor.

5. The circuit of claim 4, wherein a positive input terminal of the differential amplifier is connected to the control transistor.

6. The circuit of claim 5, wherein a negative input terminal of the differential amplifier is connected to the second terminal of the reference resistor.

7. The circuit of claim 6, further comprising a first resistor connected between the first terminal of the reference resistor and a node formed by the positive terminal of the differential amplifier and the control transistor.

8. The circuit of claim 2, wherein the second current mirror comprises a controlling diode connected to the first current mirror, and at least one mirror transistor.

9. The circuit of claim 8, wherein the second current mirror comprises a plurality of mirror transistors, each mirror transistor of the current mirror having a control switch.

10. The circuit of claim 9, further comprising a non-volatile memory to store control codes for controlling the transistor switches.

11. The circuit of claim 10, wherein the output node injects a current produced by the second current mirror into the voltage reference, and the magnitude of the current is controlled by the transistor switches.

12. The circuit of claim 10, wherein the non-volatile memory is an EEPROM that is programmed after the voltage reference circuit has been packaged.

13. The circuit of claim 2, wherein the first current mirror comprises a plurality of mirror transistors, each mirror transistor having a control switch.

14. The circuit of claim 2, wherein the differential amplifier is an output transconductance amplifier (OTA).

15. The circuit of claim 2, wherein the output node further comprises a selection switch for switching the current into one side of a band-gap core to compensate for a slope error.

16. A circuit for adjusting the level or slope trim in a voltage reference, the circuit comprising:

a differential amplifier connected across a reference resistor having a first terminal and a second terminal;

a first current mirror connected to an output of the differential amplifier; and an output node connected to the first current mirror, wherein the first current mirror sinks a current through the output node from the voltage reference.

17. The circuit of claim 16, wherein the differential amplifier is an output transconductance amplifier (OTA).

18. The circuit of claim 16, wherein the first current mirror comprises a plurality of mirror transistors, each mirror transistor having a control switch.

19. The circuit of claim 16, wherein the output node further comprises a selection switch for switching the current drawn from one side of a band-gap core to compensate for a slope error.

20. The circuit of claim 16, wherein the first current mirror comprises a control transistor and at least one mirror transistor.

21. The circuit of claim 20, wherein an output of the differential amplifier is connected to the control transistor.

22. The circuit of claim 21, wherein a positive input terminal of the differential amplifier is connected to the control transistor.

23. The circuit of claim 22, wherein a negative input terminal of the differential amplifier is connected to the second terminal of the reference resistor.

24. The circuit of claim 23, further comprising a first resistor connected between the first terminal of the reference resistor and a node formed by the positive terminal of the differential amplifier and the control transistor.

25. The circuit of claim 18, further comprising a non-volatile memory to store control codes for controlling the transistor switches.

26. The circuit of claim 25, wherein the non-volatile memory is an EEPROM that is programmed after the voltage reference circuit has been packaged.

27. The circuit of claim 26, wherein the output node draws a current from the voltage reference, and the magnitude of the current is controlled by the transistor switches.

28. A method for trimming the voltage level of an output voltage in a voltage reference circuit, the method comprising:

producing a reference current having a similar temperature coefficient as a current flowing in the voltage reference;

mirroring the reference current to produce a desired base trim current;

mirroring the base trim current to produce a desired level trim correction current; and injecting the level trim correction current into the voltage reference circuit.

29. The method of claim 28, further comprising:

programming a non-volatile memory to control the current mirroring, after the voltage reference circuit has been packaged.

30. The method of claim 29, wherein the mirroring of the reference current and the base trim current comprises selecting an appropriate combination of current mirror transistors.

31. A method for trimming the slope of an output voltage in a voltage reference circuit, the method comprising:

producing a reference current having a similar temperature coefficient as a current flowing in the voltage reference;

mirroring the reference current to produce a desired base slope current;

mirroring the base slope current to produce a desired slope trim correction current; and injecting the slope trim correction current into a band-gap core.

32. The method of claim 31, further comprising:

programming a non-volatile memory to control the current mirroring, after the voltage reference circuit has been packaged.

33. The method of claim 32, wherein the mirroring of the reference current and the base trim current comprises selecting an appropriate combination of current mirror transistors.

34. The method of claim 33, wherein the slope trim correction current is selectably injected into one side of the band-gap core to adjust the slope up or down.

35. A method for trimming the voltage level of an output voltage in a voltage reference circuit, the method comprising:

producing a reference current having a similar temperature coefficient as a current flowing in the voltage reference;

mirroring the reference current; and sinking a correction current equal to a multiple of the reference current from the voltage reference circuit.

36. The method of claim 35, further comprising:

programming a non-volatile memory to control the current mirroring, after the voltage reference circuit has been packaged.

37. The method of claim 36, wherein the mirroring of the reference current comprises selecting an appropriate combination of current mirror transistors.

38. A method for trimming the slope of an output voltage in a voltage reference circuit, the method comprising:

producing a reference current having a similar temperature coefficient as a current flowing in the voltage reference;

mirroring the reference; and sinking a correction current equal to a multiple of the reference current from a band-gap core.

39. The method of claim 38, further comprising:

programming a non-volatile memory to control the current mirroring, after the voltage reference circuit has been packaged.

40. The method of claim 39, wherein the mirroring of the reference comprises selecting an appropriate combination of current mirror transistors.

41. The method of claim 40, wherein the slope trim correction current is selectably drawn from one side of the band-gap core to adjust the slope up or down.

42. A circuit for adjusting the level or slope trim in a voltage reference, the circuit comprising:

a differential amplifier connected across a reference resistor having a first terminal and a second terminal;

a first current mirror connected to an output of the differential amplifier;

a second current mirror connected to the first current mirror;

a third current mirror; and an output node connected to the second and third current mirrors.

43. The circuit of claim 42, wherein the second current mirror injects a correction current into the voltage reference and the third current mirror draws a correction current out of the voltage reference, as selected by transistor switches controlled by a non-volatile memory.

44. The circuit of claim 43, wherein the differential amplifier produces a reference current having a similar temperature coefficient as a current flowing in the voltage reference.

45. The circuit of claim 44, wherein the correction current produced by the second current mirror or the third current mirror has a similar temperature coefficient as the current flowing in the voltage reference.

* * * * *